US007552491B2

(12) United States Patent
Voelker

(10) Patent No.: US 7,552,491 B2
(45) Date of Patent: Jun. 30, 2009

(54) LYING SURFACE FOR A BED, IN PARTICULAR A HEALTHCARE AND/OR HOSPITAL BED

(75) Inventor: Heinrich Voelker, Witten (DE)

(73) Assignee: Voelker AG, Witten (DE)

( * ) Notice: Subject to any disclaimer, the term of this patent is extended or adjusted under 35 U.S.C. 154(b) by 323 days.

(21) Appl. No.: 11/589,315

(22) Filed: Oct. 27, 2006

(65) Prior Publication Data

US 2007/0101498 A1 May 10, 2007

(30) Foreign Application Priority Data

Nov. 10, 2005 (EP) ..... 05110613
Feb. 4, 2006 (DE) ..... 20 2006 001 755

(51) Int. Cl.
*A61G 7/057* (2006.01)

(52) U.S. Cl. ..... 5/612; 5/241; 5/244; 5/934; 601/98

(58) Field of Classification Search ..... 5/933, 5/934, 612, 613, 241, 244; 601/49, 51, 98–100
See application file for complete search history.

(56) References Cited

U.S. PATENT DOCUMENTS 2,773,498 A * 12/1956 Himmelman ..... 601/98
3,970,077 A * 7/1976 Dahl ..... 601/99
4,644,593 A * 2/1987 O'Brien ..... 5/613
5,058,224 A * 10/1991 Aschwanden et al. ..... 5/238
5,060,326 A 10/1991 Oswald
5,109,558 A 5/1992 Di Blasi
5,265,290 A * 11/1993 Van Raemdonck ..... 5/236.1
5,626,555 A 5/1997 Di Blasi et al.
5,708,996 A * 1/1998 Marenco ..... 5/613
7,159,255 B2 * 1/2007 Piraino ..... 5/238

FOREIGN PATENT DOCUMENTS

EP 0 374 742 A1 6/1990
EP 0 788 786 A2 8/1997
EP 0 934 740 A2 8/1999
WO WO 03/045600 A1 6/2003

* cited by examiner

*Primary Examiner*—Michael Trettel
(74) *Attorney, Agent, or Firm*—Shumaker & Sieffert, P.A.

(57) ABSTRACT

A lying surface for a bed, especially for a healthcare and/or hospital bed, comprises support elements (22) and at least one electro-mechanic lifting unit (20) for lifting and lowering one of the support elements (22) relative to a bearing element (62) of the support element (22). The at least one lifting unit (20) comprises a housing (24) with an electromotor (32) having a drive shaft (34), a transmission (38) and a lifting member (50) supported at the bearing element (62) of said one support element (22). The lifting member (50) is adapted to be rotated by the transmission (38) and to be moved both up and down during a rotary movement of 360°.

28 Claims, 7 Drawing Sheets

LYING SURFACE FOR A BED, IN PARTICULAR A HEALTHCARE AND/OR HOSPITAL BED

BACKGROUND OF THE INVENTION

1. Field of the Invention

The invention is directed to a lying surface for a bed, in particular a healthcare and/or hospital bed.

It is generally known to provide a decubitus prophylaxis in particular to long-term hospital or healthcare patients. Here, a stimulation and a partial pressure relief of the body to be treated is obtained by local minimal movements of the lying surface. Clinical studies have proven the medicinal efficiency of such systems.

2. Description of Related Art

For decubitus prophylaxis and for pain therapy, prior art knows special pneumatic mattresses. Further, for example from WO-A-03/028511, an underspringing for mattresses is known, i.e. a mattress support surface with mattress supporting bars extending transverse to the length of the bed, at least several of which are adapted to be purposefully moved up and down pneumatically. Similar systems with fluid-controlled actuators (i.e. pneumatically or hydraulically operated actuators) are known from EP-A-0 934 740 and EP-A-0 734 742, U.S. Pat. No. 5,109,558, U.S. Pat. No. 5,060,326, and WO-A-03/045300. Besides fluid-operated actuators, these further documents mentioned also describe electromotive actuators. Further systems of the above type are described in EP-A-0 788 786 and U.S. Pat. No. 5,626,555.

The basic problem of the use of actuators to generate local lifting movements within a lying surface of a bed is the rather substantial noise produced by such systems. Both pneumatic and electromotive actuators generate noise when in operation, which may be perceived by the patients or the persons to be cared for as irritating and disturbing.

SUMMARY OF THE INVENTION

It is an object of the present invention to provide a lying surface for a bed, especially a healthcare and/or hospital bed, wherein the lifting units for lifting and lowering at least some of the support elements of the lying surface generate as little noise as possible that advantageously is below the level of normal ambient noise.

To achieve this object the invention provides a lying surface for a bed, especially for a healthcare and/or hospital bed, the lying surface being provided with support elements and at least one electro-mechanic lifting unit for lifting and lowering one of the support elements relative to a bearing element of the support element.

According to the invention, this lying surface is characterized in that the at least one lifting unit comprises a housing with an electromotor having a drive shaft, a transmission and a lifting member supported at the bearing element of said one support element, and the lifting member is adapted to be rotated by the transmission and to be moved both up and down during a rotary movement of 360°.

According to the invention, the lying surface has a plurality of support elements, at least one of which is adapted to be moved up and down by at least one electro-mechanic lifting unit. The lifting unit is supported at a bearing element of a frame or a similar understructure, for example, associated to the support element. As an alternative, the lying surface of the preset invention may be the surface on which the patient or the person to be nursed rests, or it may be a support surface on which the mattress or the like rests, whose upper surface in turn forms the lying surface for a patient or the person to be nursed. In other words: the invention may be arranged outside a mattress or the like, or it may be integrated in a mattress or the like.

According to the invention, the at least one lifting unit comprises an electromotor and a transmission, in particular configured as a reduction gear, moving a lifting member. The lifting member is supported at the bearing element of the support element of the lying surface adapted to be moved up and down by the lifting unit. The electromotor and the transmission are accommodated in a common housing that is connected with the support element adapted to be moved up and down and receives the same preferably in a receptacle of the housing as is the case when the support elements are configured as slats. Suitably, the lifting member is also accommodated in the housing.

As provided by the invention, the up and down movement of the lifting member or by the lifting member, respectively, is effected through a rotary movement of 360°. Thus, the rotary movement of the lifting member is not inverted for the lifting or lowering movement. The drive motor always rotates in one and the same sense of rotation, whereby it is avoided to repeatedly brake the motor and accelerate it again in the opposite sense of rotation to perform both movements of the lifting member. This in turn reduces noise since the development or generation of noise caused by braking and accelerating the motor can be avoided. Moving the support element(s) of the lying surface up and down may be realized in various different ways. With a view to driving the electromotor, it is somewhat complex to make the lifting member move in opposite directions to perform the lifting and lowering movement. In this respect it is advantageous if the lifting member performs both movements while the drive shaft of the electromotor always rotates in the same sense of rotation. This means in turn that the lifting member is configured as a part of a crank drive or as an element controlled by a slotted link or a cam track. To perform a lifting movement, a crank drive requires substantial force transmission in at least two rotational positions of the crank. In view of this, a rotatory element with a cam track control seems suitable as a lifting member. The rotatable lifting member is provided with a radially or axially projecting cam adapted to be moved under control in a slotted link or along a cam track as the lifting member rotates. A configuration of a rotationally driven lifting member with cam track control results in one lifting and lowering movement through a 360° rotation. For the electromotor to carry out the necessary stroke with the required force at minimum power, which, in first approximation, results in not too much noise being generated by the motor, it is suitable that the lifting member performs the lifting movement through as large a rotational angle range as possible. Thus, it is suitable in this respect if the upward movement is carried out through more than 180° of the rotary movement of the lifting member and, in particular, is carried out through 270° or more than 270°. It is not disadvantageous for the downward movement of the lifting member or the support element, respectively, if it is carried out through a substantially smaller rotational angle range compared to the upward movement, which, for example, covers only 90° in the latter case mentioned above.

Instead of a cam, a cam track controlled lifting member may also have a beveled front end abutting a counter bevel surface beveled under the same angle. When the lifting member thus configured is rotated about a rotational axis extending through the front end side with respect to the (stationary) counter bevel surface, the two bevel surfaces alternately move apart and towards each other. Here, the beveled front end side of the lifting member performs a tumbling movement. To reduce wear on the contacting beveled surfaces, it is advantageous to rotatably support a ring element either at the front end side of the lifting element or at the counter bevel surface, the ring element being in contact with the opposite bevel surface. This ring element is supported for rotation about a rotational axis extending vertically to the bevel surface at which the ring element is provided. Thus, the ring element rolls on the bevel surface opposite thereto when both are rotated relative to each other. Preferably, the rotatable support of the ring element is obtained by a roller bearing. The rolling movement occurring in the lifting member is relatively noise-free which has an advantageous effect on the overall noise generation of the lifting unit.

In an advantageous development of the invention, it is further provided that the lifting member comprises a disc element oriented under an acute angle with the rotational axis of the lifting member and supported at a counter bevel of the lifting member, the disc element and the counter bevel being oriented under the same acute angle with the rotational axis of the lifting member. In this embodiment of the lifting member, the same has a shaft divided along a plane oblique to the longitudinal axis of the shaft. One part of the lifting member shaft is stationary, whereas the other part of the haft may be rotated about its longitudinal axis. Thus, the rotatable part of the shaft moves away from the stationary part of the shaft during its rotation through 360° (through the first partial rotation in the range between 180° and 270°) to then move back towards the stationary shaft (during the second half of the rotation). In doing so, the bevel surface of the rotatable shaft part rolls on the bevel surface of the stationary shaft part. In order to avoid wear or to reduce friction, this can be improved by providing the disc element with a rotatably supported outer ring element that, when the disc element is rotated, rolls on the counter bevel relative thereto.

To influence the rotational angle range through which the rotatable shaft part moves away from the stationary shaft part, it is advantageous to arrange the disc element eccentrically with respect to the rotational axis of the rotating shaft part. The disc element with its rotatably supported outer ring element may be supported both at the stationary shaft part and the rotatable shaft part. This always has the same effect on the cinematic of the lifting member. The rotatable support of the outer ring element, which is supported at the opposite bevel surface and rolls thereon, is also advantageous in reducing noise.

A further reduction of noise generation is advantageously realized by decoupling the vibrations of the electromotor to the housing and/or of the drive shaft of the electromotor to the transmission. This decoupling results in a damped transmission of the vibrations of the electromotor to the housing and the transmission (and, moreover, to the housing, the lifting member and the bearing point at which the lifting member is supported). It is advantageous to also support the transmission in a vibration-damped manner in the housing. In this embodiment, the electromotor is supported in the housing in a vibration-damping manner to decouple vibrations propagating from the electromotor to the housing, and in addition or alternatively, the drive shaft of the electromotor has a vibration-damping section for the decoupling of vibrations from the electromotor to the transmission and/or a flexible shaft to be coupled mechanically with the transmission for compensating a radial offset between the drive shaft of the electromotor and the input shaft of the transmission, said offset being caused by tolerances, for example.

The vibration-damping support of the electromotor and possibly of the transmission within the housing is advantageously realized using an elastomer material such as rubber or the like which partly fills the gap between the electromotor and the inner side of the housing or between the transmission and the inner side of the housing. For example, rubber O rings or rings of other elastomer materials lend themselves to this purpose. Such elements are commercially available and may be slipped over the housing when the electromotor is configured with a cylindrical housing, for example. The electromotor, and possibly also the transmission, thus rest in the housing of the lifting unit via these rings. As an alternative, the vibration-damping support may be effected through individual elastomeric bearing blocks (for example in the form of "rubber feet"). It is important for an effective reduction of noises that there is substantially no further contact between the elements of the lifting unit generating the noise, such as the electromotor and possibly the transmission, than the vibration-damping support at the housing of the lifting unit.

An alternative vibration-damping support of the electromotor and/or the transmission may also be realized, for example, by accommodating the housing of the electromotor or a housing enclosing the transmission in an air-cushioned manner in the housing of the lifting unit. Possible air-cushions are the air-bubble films known from the packaging industry.

Regarding the vibration-damping connection of the drive shaft of the electromotor with, generally, the input shaft of the transmission, rotationally symmetric connecting elements, such as sleeves, a (solid) shaft or the like connections or coupling elements, are particularly suited which are connected in a torque-proof manner with both the drive shaft of the electromotor and the input shaft of the transmission. These torque-proof connections may be realized by frictional, positive or material engagement. For example, the vibration-damping material of the connecting portion between the drive shaft of the electromotor and the input shaft of the transmission may be vulcanized (material engagement). By providing a profile having in particular axially extending ribs on the drive shaft of the electromotor or the input shaft of the transmission, a positive engagement with a sleeve-shaped connecting portion element, for example, slipped on the shafts is obtained. A frictional engagement may be obtained, for example, by applying radial tension to the connection portion connecting the shafts (the tension being induced by a bias imparted to the sleeve-shaped connecting portion or by providing pressure clamps or similar connecting elements).

The vibration-damping coupling of both shafts may also be used to compensate for a possible radial offset of the shaft (flexible coupling shaft). However, according to a variant of the invention, such a flexible shaft need not necessarily have a vibration-damping effect. Rather, sufficient vibration damping is achieved by supporting and or coupling the electromotor in a vibration-damped manner in the housing of the lifting unit.

The performance requirements to the electromotor can be further reduced by using a transmission with as much of a gear reduction as possible (e.g. larger or equal to 1:250 or 1:350). This may suitably be realized by a multi-stage transmission whose input stage comprises a screw meshing with a multi-stage gear transmission unit.

Another contribution to the reduction of noise is achieved by a corresponding selection of the materials of the individual components that move on each other or mesh with each other.

Possible material combinations are PA, POM, steel and brass. This is true, for example, for the materials moving on each other in a cam track controlled embodiment of the lifting member. Further, it is advantageous to configure the housing such that it cannot act as a resonant body. In this respect, one requirement is a small volume within the housing. In other words, the housing should enclose the electromotor, the transmission, and possible other elements, such as electronic controls or the like, as closely as possible. For structural reasons, a non-reverberant configuration of the housing can be realized that reduces the transmission of sound to the outside.

An improved noise reduction can be obtained by encapsulating the electromotor and the drive shaft within the housing, i.e. they are accommodated in a closed off receiving space of the housing, from which only the drive line extends that is formed by the drive shaft, the coupling element and the transmission input shaft. On the one hand, this drive line is supported within the housing of the lifting unit only at the motor housing itself. Seen from the electromotor, a second bearing point is situated only behind the coupling element and is preferably provided outside the receiving space. By this arrangement, the vibrations caused by the drive shaft of the electromotor can be transmitted to the above mentioned bearing point and thus to the housing of the lifting unit in a state already attenuated by the coupling element.

The invention is most advantageously realized in the form of a lying surface for a mattress or a similar support. Such lying surfaces have transverse ledges or bars, at least one of which, according to the invention, is adapted to be moved up and down at least at one side or in the middle by means of the present lifting unit. The ends of the ledges rest on side frame parts or the like forming a single lying surface portion or individual separate lying surface portions which are advantageously adapted to be pivoted relative to each other. Such mattress supporting surfaces or lying surfaces are known in the art. It is advantageous for the reduced noise generation provided by the present invention, if the lifting member supported at one bearing point is uncoupled from the frame structure of the lying surface. For example, this is realized by an intermediate element connected with the frame structure of a lying surface and at which the lifting member is supported. This intermediate element suitably is made of mechanically strong but non-reverberant material such as a plastic material.

Suitably, this intermediate element is retained at a holding structure of the lying surface or the bed in a manner decoupled from vibrations. For example, this may be realized by providing elastomer material layers at the points of contact between the intermediate element and the holding structure.

BRIEF DESCRIPTION OF THE DRAWINGS

The following is a detailed description of the invention with reference to an embodiment thereof and to the accompanying drawings. In the Figures.

DESCRIPTION OF PREFERRED EMBODIMENTS OF THE INVENTION

Figure 1:
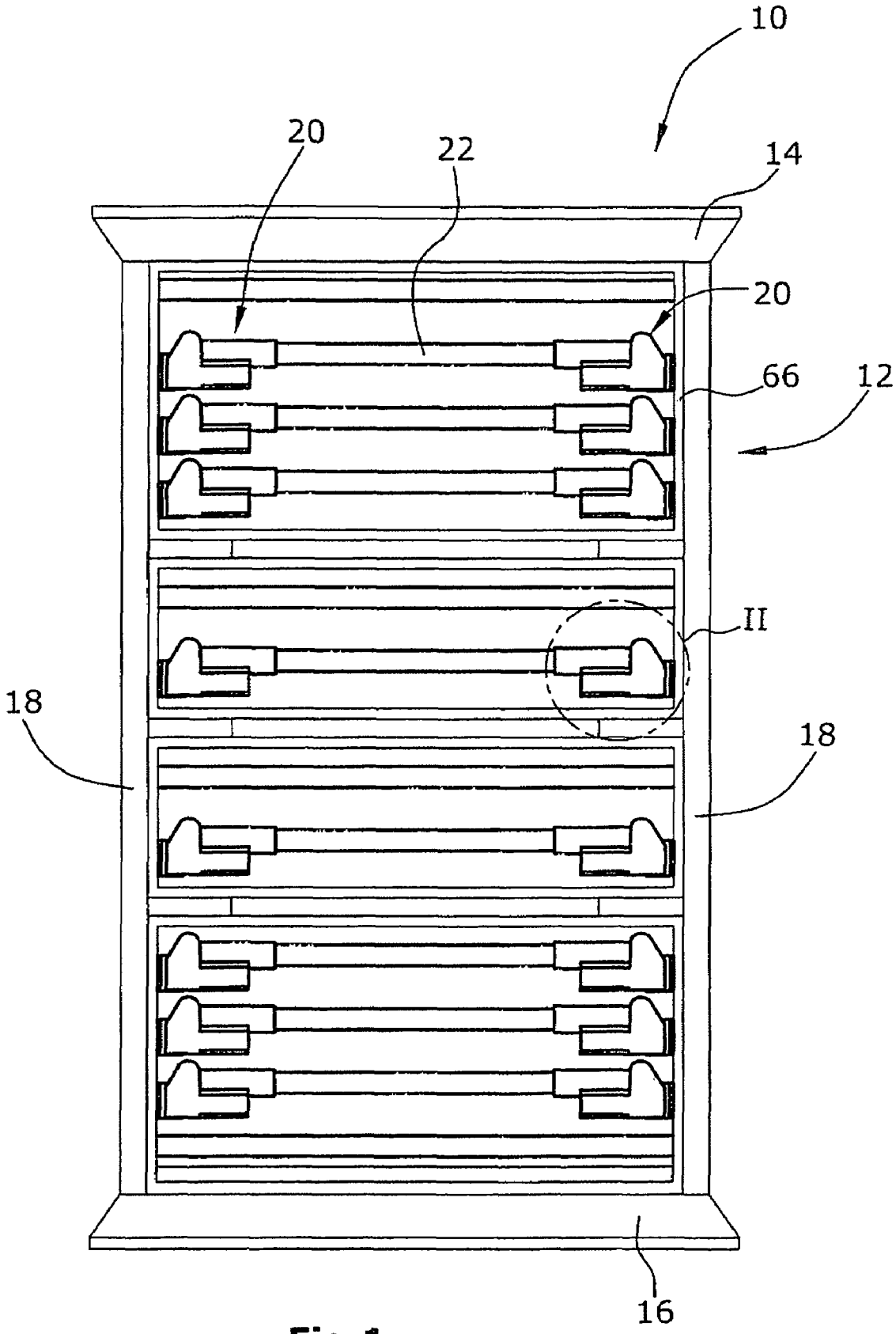
FIG. 1 is a top plan view of a lying surface of a hospital or healthcare bed with the mattress omitted for clarity.

FIG. 1 is a schematically simplified top plan view of a hospital or healthcare bed 10 with a lying surface 12 for a mattress (not illustrated), the lying surface comprising a plurality of parts in this embodiment. At the head and the foot end of the bed 10, the lying surface is limited by a head part 14 and a foot part 16, respectively, which, as provided in this embodiment, are interconnected through lateral cheeks 18. The structure of the components of the bed 10 provided beside the lying surface 10 is of importance to the invention. Further, the lying surface of the invention need not necessarily be composed of a plurality of parts. Rather, the invention should be seen in the special configuration of the lifting units 20, of which the lying surface 12 of the bed of FIG. 1 comprises a plurality and which, in this embodiment, are arranged at the ends of bars 22 that extend transversely across the lying surface 12 and serve as supporting elements. The number of the bars 22 movable by the lifting units 20 is not critical to the invention. It is also unimportant, whether a supporting element 22 of the lying surface 12 provided with a lifting unit 20 is configured as a bar. The supporting elements may as well be designed as individual plates distributed over the lying surface, or similar elements bounded on all sides, which can be raised and lowered individually by a lifting unit 20 to be described hereinafter.

Figure 2:
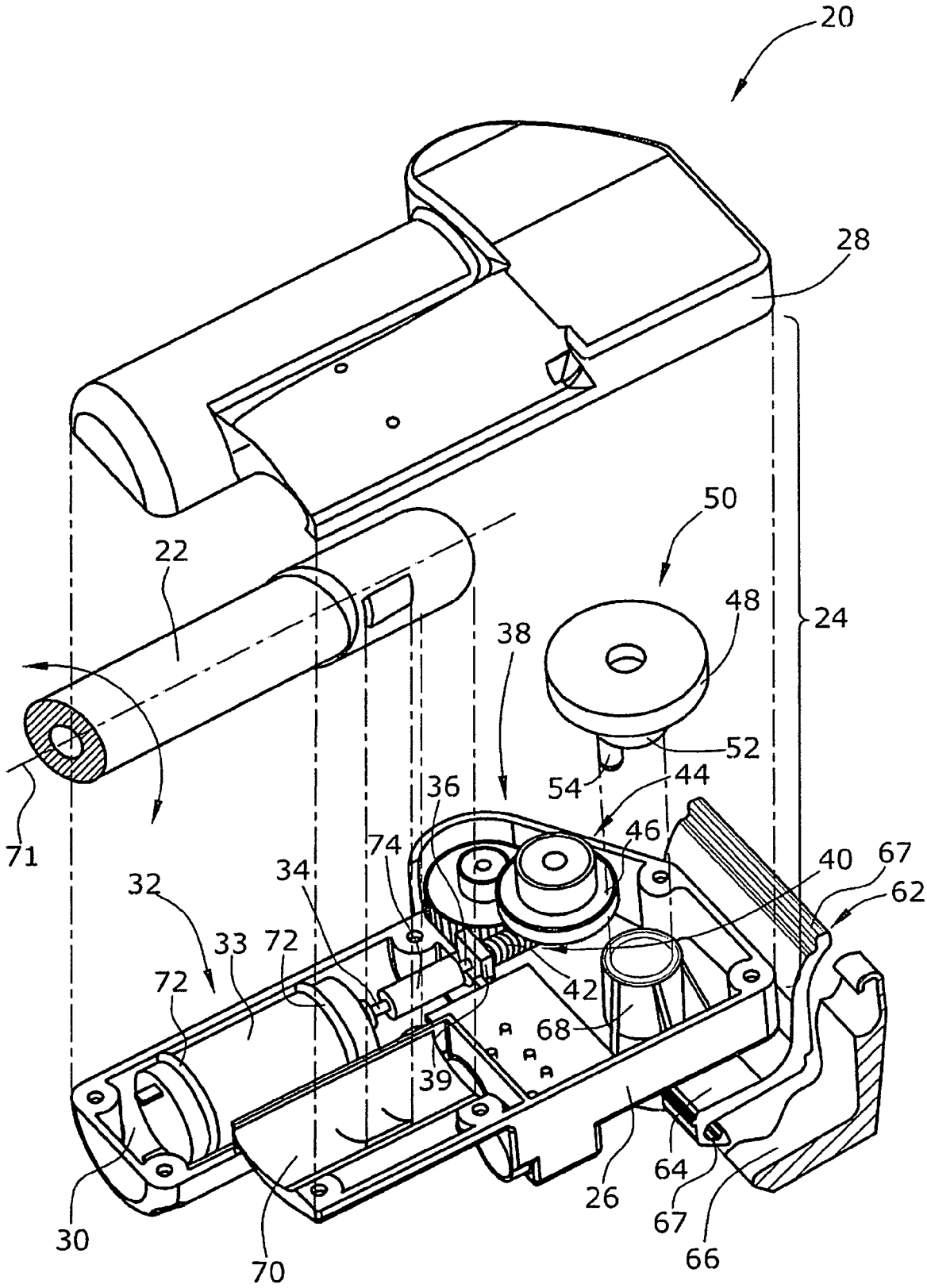
FIG. 2 is a perspective exploded view of a lifting unit and the coupling thereof to the frame structure of the lying surface.

As illustrated in FIG. 2, a lifting unit 20 has a housing 24, e.g. of plastic material, which is bipartite in the present embodiment and has a lower housing half 26 and an upper housing half 28. The two housing halves 26, 28 enclose a receiving space 30 for accommodating an electromotor 32 having a substantially cylindrical housing 33 in this embodiment. The drive shaft 34 of the electromotor 32 is coupled to the input shaft 36 of a multi-stage transmission 38, the input shaft 36 being supported within the housing 24 at a bearing 39 outside the receiving space 30. The transmission 38 has an input stage 40 in the form of a screw 42 sitting on the input shaft 36, the screw cooperating, in the present embodiment, with the two-stage pinion stage 44 of the transmission 38. The transmission 38 has a pinion 46 at its output that meshes with the outer toothing 48 of a lifting member 50. Besides the outer toothing 48, the lifting member 50 has a cylindrical projection 52 that defines a rotational axis 52 and from which a plunger 54 extends axially from an eccentric position (see also FIG. 3). The cylindrical projection and the plunger 54 are received in a sleeve 56 having a cam track 58 in its bottom in which the rounded end 60 of the plunger 54 moves when the lifting member 50 is rotated. The (bearing) sleeve 56 is part of a bearing element 62 for the lifting member 50, which has a substantially L-shaped angular portion 64 which, as indicated in FIG. 2, is connected with a frame portion 66 of the lying surface 12 by clip or hook connection, respectively. At the contact points between the bearing element 62 and the frame portion 66 of the lying surface 12, rubber coatings are provided for decoupling vibrations, the rubber coatings being indicated in the Figures by the reference numeral 67. The (bearing) sleeve 56 is introduced from below into the lower housing half 26 which has an inward projecting receiving sleeve 68 for receiving the sleeve 56. The housing 24 further comprises a receiving space 70 for an end of a bar 22, in which the bar 22 is either supported fixedly or for rotation about its longitudinal axis 71.

One aspect of the lifting unit 20 of FIGS. 2 to 5 can be seen in the vibration-damped supporting of the electromotor 32. In this embodiment, the housing 24 holds two rubber O bearing rings 72 that surround the housing 33 of the electromotor 32 and abut against the inner surface of the receiving space 30 of the housing 24. These bearing rings 72 substantially decouple the housing 24 from vibrations of the electromotor 32. Further vibration damping is found with the lifting unit 20 in the connection portion between the drive shaft 34 of the electromotor 32 and the input shaft 36 of the transmission 38. In the lifting unit 20, these two shafts are coupled by means of a rubber sleeve or shaft 74 connected in a torque-proof manner with the shafts 34 and 36 and damping the axial and the circumferentially directed vibrations of the drive shaft 34 of the electromotor 32.

Besides the above described components, further structural units, in particular control electronics and the connection system for connecting the individual lifting units to a control bus, are accommodated in the housing 24. This is not detailed in the drawings.

Figure 3:
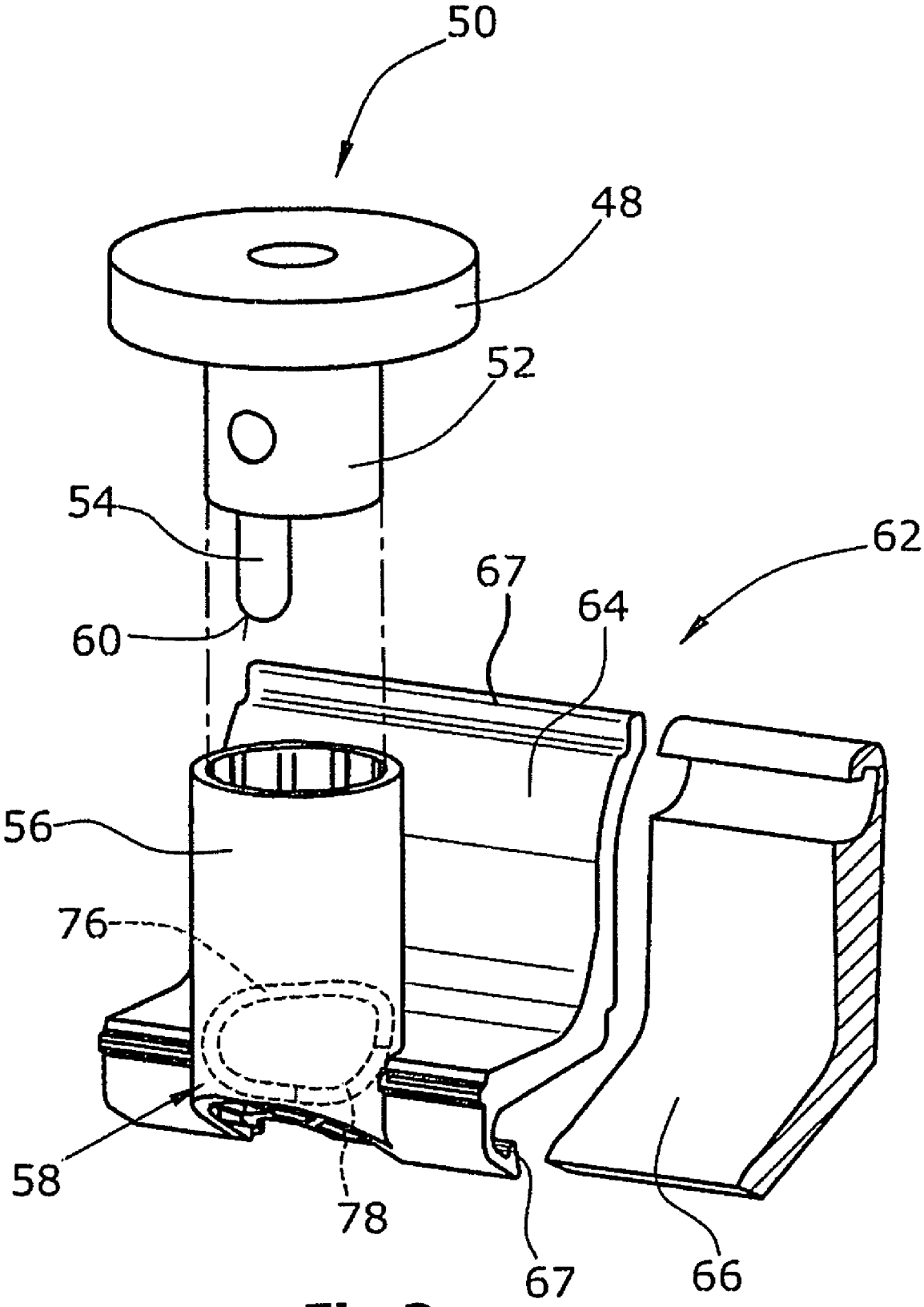
FIG. 3 is a perspective view of a detail of the lifting member and the bearing element at which the lifting member is supported.
Figure 4:
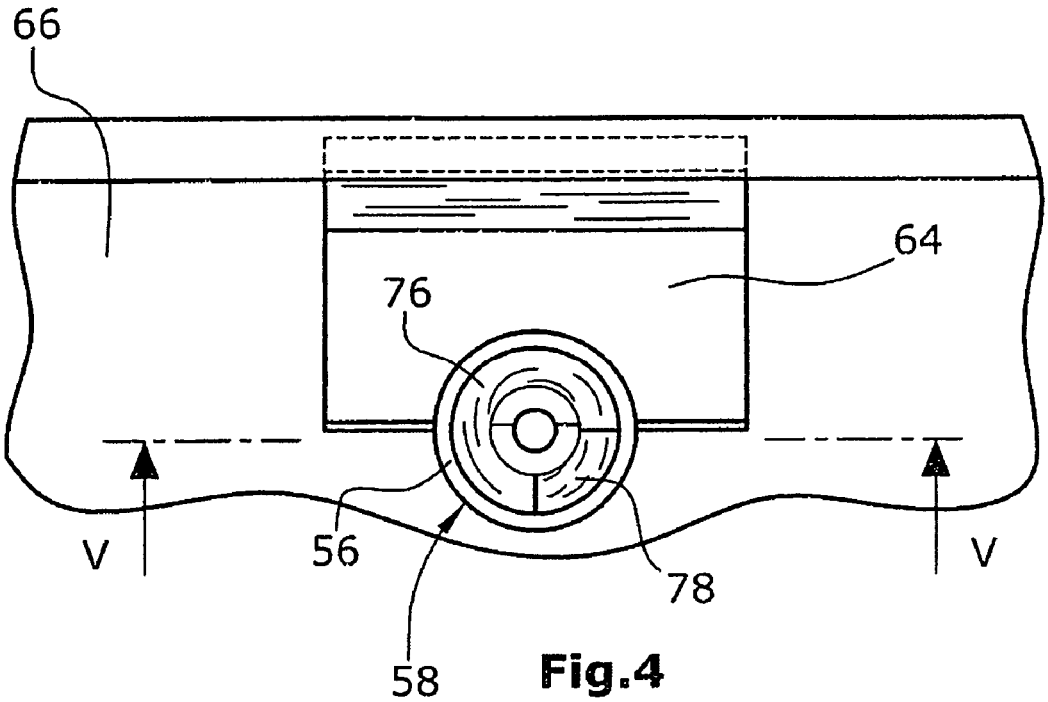
FIG. 4 is a top plan view of the bearing element of FIG. 3.
Figure 5:
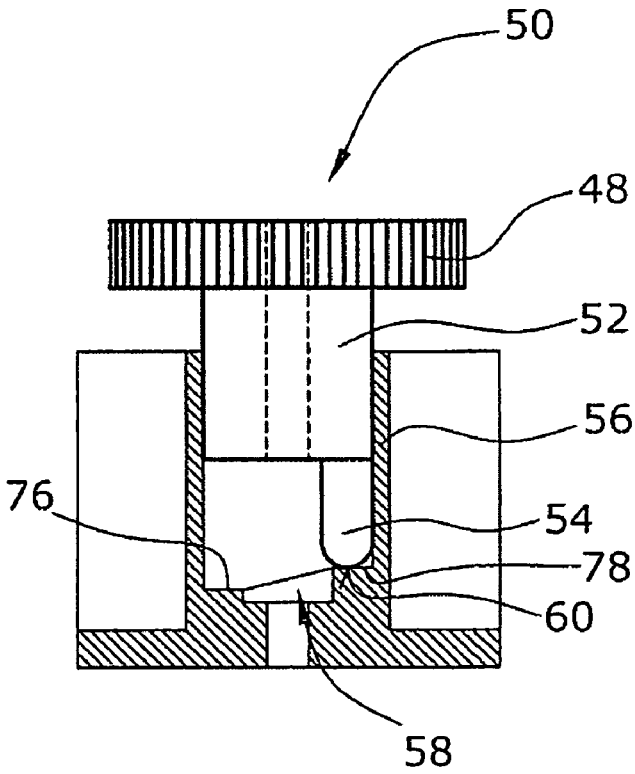
FIG. 5 is s section through the bearing element along line V-V in FIG. 4, FIGS. 6 and 7 are sections along line V-V in FIG. 4, but through an alternative bearing element and lifting member, FIG. 6 showing the situation at minimum stroke and FIG. 7 showing the situation at maximum stroke.

Referring to FIGS. 3 to 5, one embodiment of the lifting mechanism of the lifting unit 20 will now be described. As indicated in these Figures, the bottom of the (bearing) sleeve (56 is provided with a cam track 58 extending on different levels relative to the bottom of the sleeve 56. In the present embodiment, this cam track 58 rises through a circumferential angle range of 270° (see cam track section 76 in FIG. 4), whereas it declines over an angle range of 90° (see cam track section 78 in FIG. 4). The electromotor 32 thus has to generate the energy for lifting the lifting member 50 over a range of rotational angles that is larger than the range of rotational angles in which this energy is physically released again. Thus, for example, the motor does not have to be as powerful as it would have to be if the rising cam track section 76 extended over an angle range less than 270°.

Besides the vibration-damped supporting of the electromotor 32, the vibration-damped coupling of its drive shaft 34 with the transmission 38 and the optimized power rating of the electromotor 32 due to the specially designed cam track 58 with a rising cam track section 76 extending over at least 270°, the material combination of the plunger 54 and the cam track 58 (for example, steel or brass combined with PA or POM or a comparable plastic material) and the mechanical decoupling of the frame portion 66 and the bearing element 62 contribute to the noise reduction achieved with the present lifting unit 20. All this results in an optimized noise reduction, which is why the lifting unit 20 is predestined as an adjusting device for support elements of the lying surface of a health-care or hospital bed.

Figure 6:
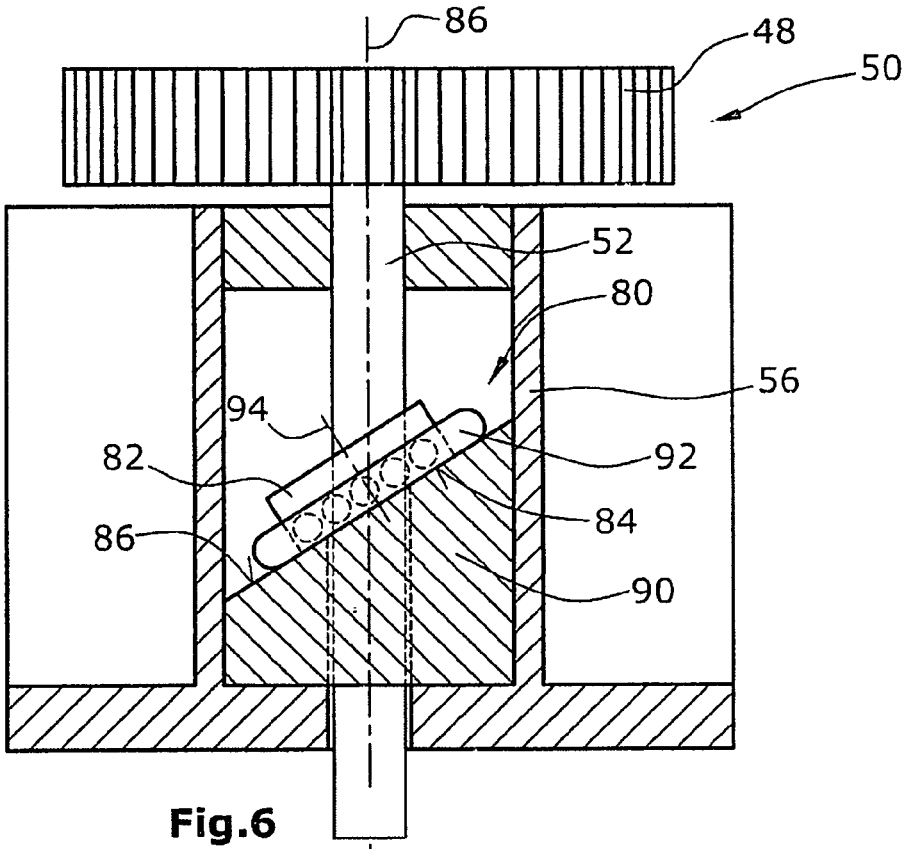
Figure 7:
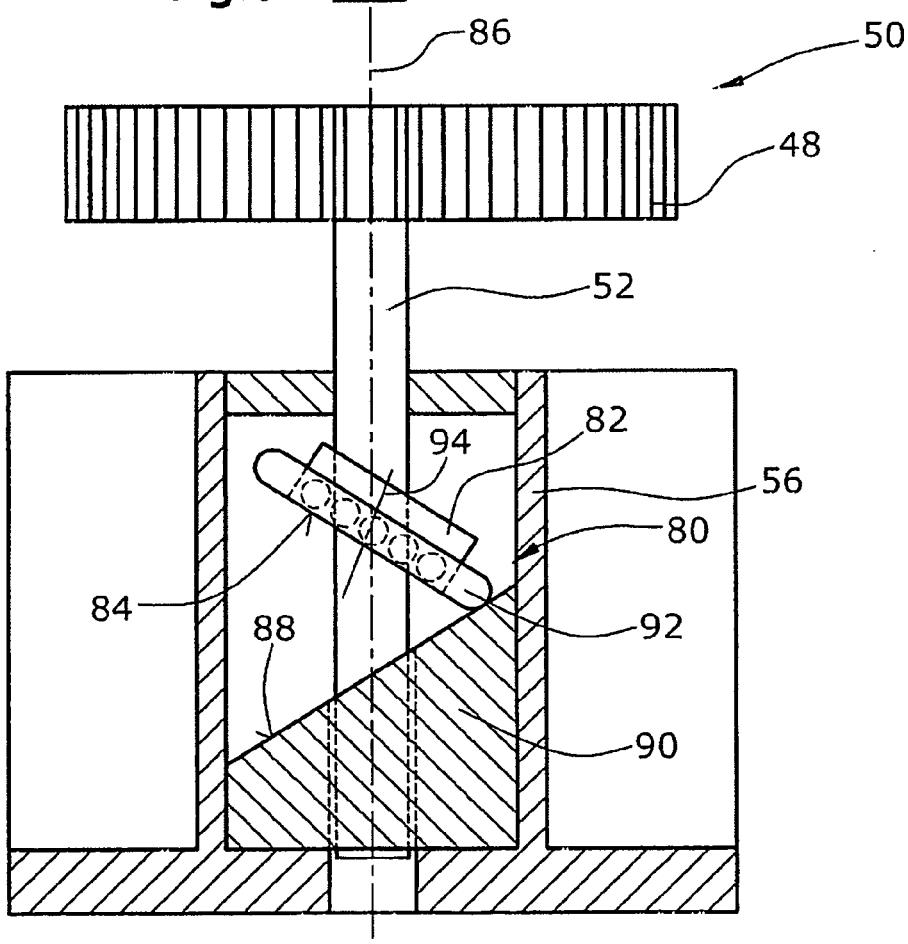

Referring to FIGS. 6 and 7, an alternative embodiment of a cam track controlled lifting member will now be described. As far as the individual components of the structure shown in FIGS. 6 and 7 are similar in function or structure to the corresponding components shown in FIGS. 2 to 5, the same reference numerals will be used.

The lifting member 50 of FIG. 6 has an outer toothing 48 for rotary drive purposes and is connected with a rotational axis 52 on which a front face element or disc element 82 is situated defining the front end 80 of the lifting member 50 and forming an beveled front face 84 of the lifting member 50. Here "beveled" means an angle smaller than 90° to the rotational axis 86 of the lifting member 50.

The beveled front face 84 of the lifting member 50 abuts a counter bevel surface 88 of a bearing or supporting element 90. Preferably, the counter bevel surface 88 is made of ceramics. Both beveled surfaces 84 and 88 have the same angle of inclination.

Rotating the lifting member 50 relative to the stationary supporting element 90 causes an up and down movement of the lifting member 50, as illustrated in FIGS. 6 and 7. To reduce wear, the front face element 82 comprises an outer ring element 92, e.g. of metal, which is supported for rotation about a rotational axis 94 extending vertically to the front face 84 of the lifting member 50. When the lifting member 50 rotates, the ring element 92 rolls on the counter bevel surface 88. Besides protecting the material, this is also advantageous with a view to a possible noise generation since the rolling produces only hardly audible noise, if any.

The lifting member 50 is guided in the bearing or supporting element (and in the housing of the lifting unit) by means of the rotational axis 52 extended by the front face element 82, the axis passing through an axial throughbore in the bearing or supporting element 90.

Figure 8:
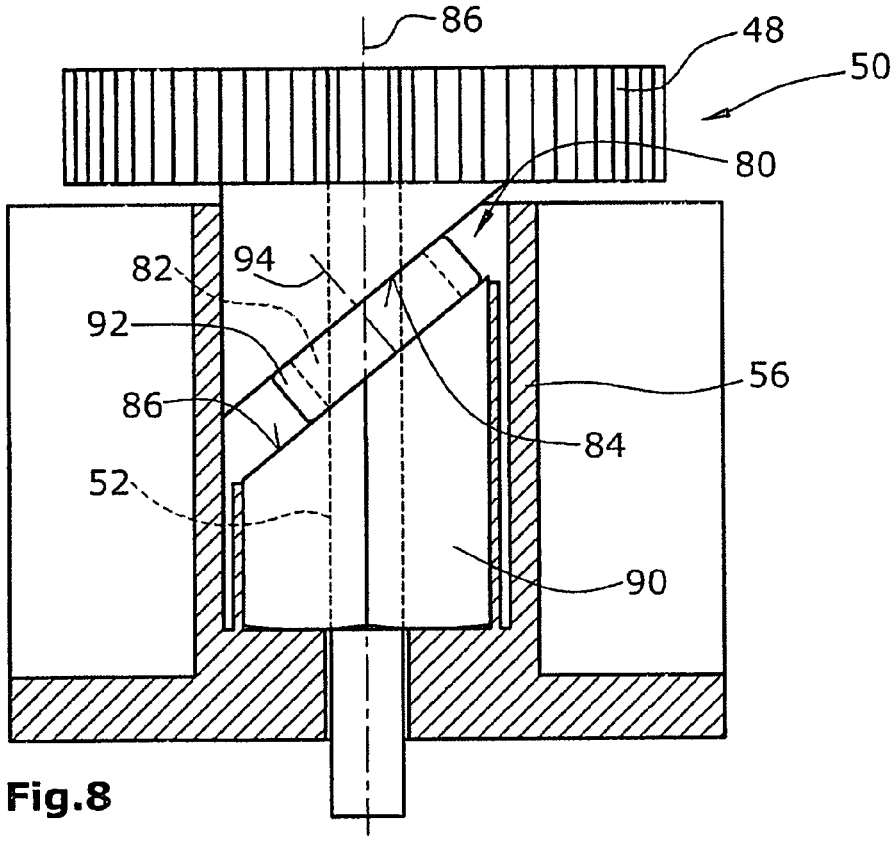
FIGS. 8 and 9 are sections along line V-V in FIG. 4, but through another alternative bearing element and lifting member, FIG. 8 showing the situation at minimum stroke and FIG. 9 showing the situation at maximum stroke.
Figure 9:
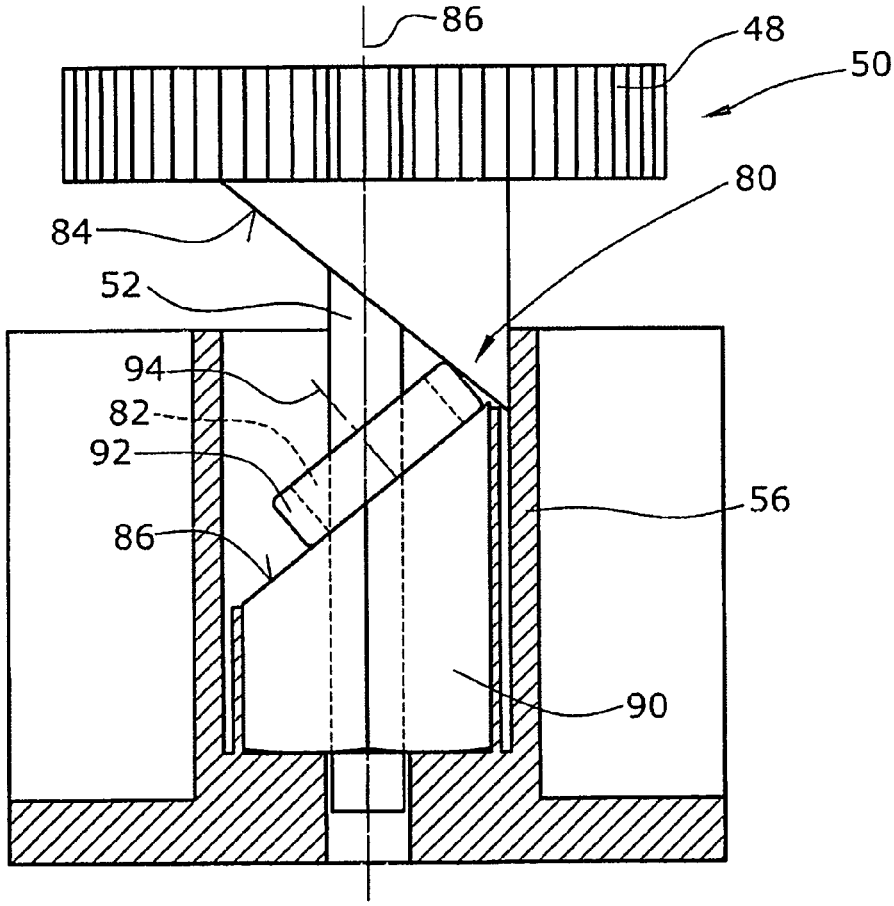
Figure 10:
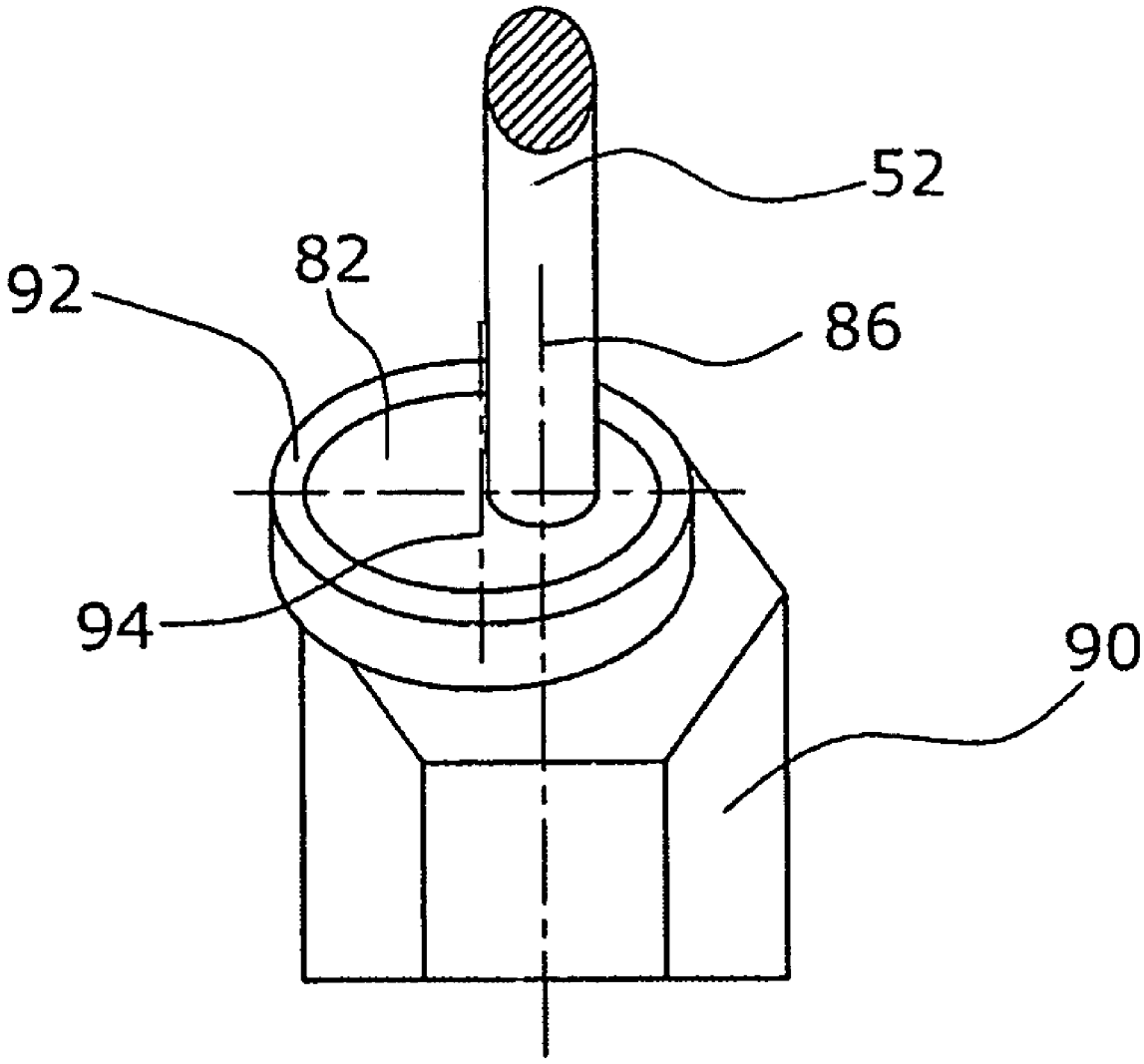
FIG. 10 is a perspective view of a part of the lifting member according to FIGS. 8 and 9.

The positions of the front face element 82 with the rotatably supported ring element 92, on the one hand, and of the bearing or supporting element 90 with the counter bevel surface 88, on the other hand, may also be switched so that the counter bevel surface is provided at the rotational axis 52 about which the lifting member 50 rotates, and the ring element is formed with an inclination at a stationary part, as illustrated in FIGS. 8 and 9. Further, in both variants, the ring element may be supported eccentrically with respect to the rotational axis 52 (illustrated in FIG. 10 for the embodiment of FIGS. 8 and 9), influencing the function of the stroke over the rotational angle. It is thus possible to perform the upward movement of the lifting member 50 over more than 180°, for example, the downward movement being accordingly carried out over a range of rotational angles correspondingly smaller than 180° (similar to what has been shown in FIGS. 3 to 5 for the first embodiment).

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

The present application claims the priority of German Utility Model Application No. 20 2006 001 755.0 and European Patent Application no. 05 110 613.6 which are herewith incorporated herein by reference.

What is claimed is:

1. A lying surface for a bed, the lying surface comprising:

support elements (22) and at least one electro-mechanic lifting unit (20) for lifting and lowering one of the support elements (22) relative to a bearing element (62) of the support element (22), wherein the at least one lifting unit (20) comprises a housing (24) with an electromotor (32) having a drive shaft (34), a transmission (38) and a lifting member (50) supported at the bearing element (62) of said one support element (22), the lifting member (50) is adapted to be rotated by the transmission (38) and to be moved both up and down during a rotary movement of 360°, and the lifting member (50) has a disc element (82) oriented under an acute angle to a rotational axis (86) of the lifting member (50) and supported at a counter bevel surface (88) of the lifting member (50), the disc element (82) and the counter bevel surface (88) being oriented under the same acute angle to the rotational axis (86) of the lifting member (50).

2. The lying surface of claim 1, wherein the lifting member (50) is adapted to be moved upward through a rotational angle range of substantially 180°and to be moved downward through the rest of a rotation.

3. The lying surface of claim 1, wherein the lifting member (50) is adapted to be moved upward through a range of rotational angles larger than 180° and to be moved downward for the rest of a rotation.

4. The lying surface of claim 3, wherein the lifting member (50) is adapted to be moved upward through a range of rotational angles of substantially 270° and to be moved downward for the rest of a rotation.

5. The lying surface claim 1, wherein the disc element (82) comprises a rotatably supported ring element (92) rolling on the counter bevel surface (88) when the disc element (82) is rotated relative thereto.

6. The lying surface of claim 1, wherein the disc element (82) is arranged laterally offset from the rotational axis of the lifting member (50) such that its axis (94) does not intersect the rotational axis (86).

7. The lying surface of claim 1, wherein the rotational axis (86) passes through the disc element (82) eccentrically.

8. The lying surface of claim 1, wherein the disc element (82) is stationary and the counter bevel surface (88) is rotatable about the rotational axis (86).

9. The lying surface of claim 1, wherein the disc element (82) is rotatable about the rotational axis (86) of the lifting member (50) and the counter bevel surface (88) is stationary.

10. The lying surface of claim 1, wherein the housing (24) encloses the electromotor (32) and the transmission (38).

11. The lying surface of claim 1, wherein the housing (24) has a closed off receiving space (30) for the electromotor (32).

12. A lying surface for a bed, the lying surface comprising:

support elements (22) and at least one electro-mechanic lifting unit (20) for lifting and lowering one of the support elements (22) relative to a bearing element (62) of the support element (22), wherein the at least one lifting unit (20) comprises a housing (24) with an electromotor (32) having a drive shaft (34), a transmission (38) and a lifting member (50) supported at the bearing element (62) of said one support element (22), the lifting member (50) is adapted to be rotated by the transmission (38) and to be moved both up and down during a rotary movement of 360°, and the electromotor (32) is supported in the housing (24) in a vibration-damping manner to decouple vibrations propagating from the electromotor (32) to the housing, and the drive shaft (34) of the electromotor (32) has a vibration-damping section (74) for decoupling of vibrations from the electromotor (32) to the transmission (38) and a flexible shaft coupled mechanically with the transmission (38) for compensating a radial offset between the drive shaft of the electromotor and the input shaft of the transmission, said offset being caused by tolerances.

13. The lying surface of claim 12, wherein a vibration-damping support of the electromotor (32) in the housing (24) is formed by an air cushion or elastomer material arranged between them and is configured as at least one support element (72) including elastomer material.

14. The lying surface of claim 12, wherein the vibration-damping coupling section (74) comprises an elastomer material between the drive shaft (34) of the electromotor (32) and the transmission (38), said vibration-damping coupling section (74) being made of said elastomer material.

15. The lying surface of claim 14, wherein the coupling section (74) is configured as a shaft connected in a torque-proof manner with the drive shaft (34) of the electromotor (32) and an input shaft (36) of the transmission (38).

16. The lying surface of claim 12, wherein the lifting member (50) is cam controlled to perform an upward and downward movement.

17. The lying surface of claim 16, wherein the lifting member (50) has an axially or radially projecting cam guided along a cam track or a slotted link.

18. The lying surface of claim 12, wherein the lifting member (50) has a beveled front face (84) abutting against a counter bevel surface (88).

19. The lying surface of claim 18, wherein the lifting member (50) has a ring element (92) at its front face (84), and the ring element (92) contacts the counter bevel surface (88) and is supported at the lifting member (50) for rotation about a rotational axis (94) extending vertically to the front face (84) at the front face of the lifting member (50).

20. A lying surface for a bed, the lying surface comprising:

support elements (22) and at least one electro-mechanic lifting unit (20) for lifting and lowering one of the support elements (22) relative to a bearing element (62) of the support element (22), wherein the at least one lifting unit (20) comprises a housing (24) with an electromotor (32) having a drive shaft (34), a transmission (38) and a lifting member (50) supported at the bearing element (62) of said one support element (22), the lifting member (50) is adapted to be rotated by the transmission (38) and to be moved both up and down during a rotary movement of 36020 , and the transmission (38) is a multi-stage and reduction transmission and comprises a screw (42) connected with the drive shaft (34) of the electromotor (32) via a coupling section (74), said screw meshing with a gear stage (44) that is in rotational engagement with the lifting member (50).

21. A lying surface for a bed, the lying surface comprising:

support elements (22) and at least one electro-mechanic lifting unit (20) for lifting and lowering one of the support elements (22) relative to a bearing element (62) of the support element (22), wherein the at least one lifting unit (20) comprises a housing (24) with an electromotor (32) having a drive shaft (34), a transmission (38) and a lifting member (50) supported at the bearing element (62) of said one support element (22), the lifting member (50) is adapted to be rotated by the transmission (38) and to be moved both up and down during a rotary movement of 360°, and a drive line comprising the drive shaft (34) of the electromotor (32), a coupling section (74) and an input shaft (36) of the transmission (38) is supported within the housing (24) at a bearing (39) which, seen from the electromotor (32), is situated behind the coupling section (74).

22. The lying surface of claim 21, wherein the bearing (39) is situated outside a receiving space (30) for the electromotor (32).

23. A lying surface for a bed, the lying surface comprising:

support elements (22) and at least one electro-mechanic lifting unit (20) for lifting and lowering one of the support elements (22) relative to a bearing element (62) of the support element (22), wherein the at least one lifting unit (20) comprises a housing (24) with an electromotor (32) having a drive shaft (34), a transmission (38) and a lifting member (50) supported at the bearing element (62) of said one support element (22), the lifting member (50) is adapted to be rotated by the transmission (38) and to be moved both up and down during a rotary movement of 360°, and the support elements (22) are configured as bars on which a mattress or a like support rests.

24. The lying surface of claim 23, wherein the housing (24) comprises a receiving space (70) for an end of one of said bars (22).

25. The lying surface of claim 24, wherein the end of the bar (22) is received by the receiving space (70) in a manner pivotable about the longitudinal axis of the bar (22).

26. A lying surface for a bed, the lying surface comprising:

support elements (22) and at least one electro-mechanic lifting unit (20) for lifting and lowering one of the support elements (22) relative to a bearing element (62) of the support element (22), wherein the at least one lifting unit (20) comprises a housing (24) with an electromotor (32) having a drive shaft (34), a transmission (38) and a lifting member (50) supported at the bearing element (62) of said one support element (22), the lifting member (50) is adapted to be rotated by the transmission (38) and to be moved both up and down during a rotary movement of 360°, and the bearing element (62) at which the lifting member (50) of the at least one lifting unit (20) is supported is attached to a frame portion (66) of a mattress under-springing comprising the bars (22).

27. A lying surface for a bed, the lying surface comprising:

support elements (22) and at least one electro-mechanic lifting unit (20) for lifting and lowering one of the support elements (22) relative to a bearing element (62) of the support element (22), wherein the at least one lifting unit (20) comprises a housing (24) with an electromotor (32) having a drive shaft (34), a transmission (38) and a lifting member (50) supported at the bearing element (62) of said one support element (22), the lifting member (50) is adapted to be rotated by the transmission (38) and to be moved both up and down during a rotary movement of 360°, and the support elements (22), the at least one lifting unit (20) and the bearing elements (62) are integrated in a mattress.

28. A lying surface for a bed, the lying surface comprising:

support elements (22) and at least one electro-mechanic lifting unit (20) for lifting and lowering one of the support elements (22) relative to a bearing element (62) of the support element (22), wherein the at least one lifting unit (20) comprises a housing (24) with an electromotor (32) having a drive shaft (34), a transmission (38) and a lifting member (50) supported at the bearing element (62) of said one support element (22), the lifting member (50) is adapted to be rotated by the transmission (38) and to be moved both up and down during a rotary movement of 360°, and the transmission (38) of the at least one lifting unit (20) is supported in a vibration-damped manner within the housing (24) by an elastomer material between the transmission (38) or a housing part accommodating the same and the housing (24) of the lifting unit (20).

* * * * *

UNITED STATES PATENT AND TRADEMARK OFFICE

CERTIFICATE OF CORRECTION

PATENT NO. : 7,552,491 B2
APPLICATION NO. : 11/589315
DATED : June 30, 2009
INVENTOR(S) : Heinrich Voelker It is certified that error appears in the above-identified patent and that said Letters Patent is hereby corrected as shown below:

Title page, (30) "Nov. 10, 2005 (EP) ..... 05110613" should read -- Nov. 10, 2005 (EP) ..... 05110613.6 --

Title page, (30) "Feb. 4, 2006 (DE) ..... 20 2006 001 755" should read -- Feb. 4, 2006 (DE) ..... 20 2006 001 755.0 --

Title page, (56) "WO WO 03/045600 A1 6/2003" should read -- WO WO 03/045300 A1 6/2003 --

Column 10, line 43, "during a rotary movement of 36020 , and" should read -- during a rotary movement of 360°, and --

Signed and Sealed this

Twenty-fourth Day of August, 2010

David J. Kappos

David J. Kappos
*Director of the United States Patent and Trademark Office*